US009689637B1

(12) United States Patent
Beltz et al.

(10) Patent No.: US 9,689,637 B1
(45) Date of Patent: Jun. 27, 2017

(54) BRACE FOR STABILIZING A FIREARM

(71) Applicant: B-5, Inc., Wichita, KS (US)

(72) Inventors: Kasey Dallas Beltz, Wichita, KS (US); Mark Charles Berry, Virginia Beach, VA (US)

(73) Assignee: B-5, INC., Wichita, KS (US)

( * ) Notice: Subject to any disclaimer, the term of this patent is extended or adjusted under 35 U.S.C. 154(b) by 0 days.

(21) Appl. No.: 14/847,799

(22) Filed: Sep. 8, 2015

Related U.S. Application Data

(60) Provisional application No. 62/047,845, filed on Sep. 9, 2014.

(51) Int. Cl.
*F41A 23/02* (2006.01)
*F41A 23/08* (2006.01)

(52) U.S. Cl.
CPC ..... *F41A 23/02* (2013.01); *F41A 23/08* (2013.01)

(58) Field of Classification Search
CPC ..... F41A 23/02; F41A 23/08; F41A 23/10; F41A 23/12; F41A 23/14; F41A 23/16; F41A 23/18
USPC ..... 42/94; 89/37.04, 37.13; 248/682, 689; D22/108, 111
See application file for complete search history.

(56) References Cited

U.S. PATENT DOCUMENTS

| | | | | |
|---|---|---|---|---|
| 3,947,988 | A * | 4/1976 | Besaw | F41A 23/00 42/94 |
| 4,017,997 | A * | 4/1977 | Peterson | F41A 23/08 42/94 |
| 4,196,742 | A * | 4/1980 | Owen, Jr. | A63C 11/221 135/66 |
| 7,578,090 | B1 * | 8/2009 | Romaszka | F41G 11/003 42/85 |
| 7,614,174 | B1 * | 11/2009 | Beltz | F41A 23/10 42/72 |
| 2004/0064994 | A1 * | 4/2004 | Luke | F41C 23/16 42/85 |
| 2007/0079541 | A1 * | 4/2007 | Peterson | F41A 23/08 42/94 |
| 2009/0000175 | A1 * | 1/2009 | Potterfield | F41A 23/10 42/94 |
| 2009/0049731 | A1 * | 2/2009 | Seuk | F41A 23/16 42/94 |
| 2010/0307046 | A1 * | 12/2010 | Cheng | F41C 27/22 42/94 |
| 2013/0000174 | A1 * | 1/2013 | Troy | F41C 23/16 42/72 |
| 2014/0259851 | A1 * | 9/2014 | Cuddeback | F41A 23/06 42/94 |

* cited by examiner

*Primary Examiner* — Bret Hayes

(57) ABSTRACT

A padded brace for a firearm includes a body which is arranged for mounting to the underside of the muzzle end of a firearm stock. The padded brace includes a body which presents a forward facing brace portion which presents a surface which is suitable for gripping upright surfaces. A padded portion is fixed underneath the body. The padded portion is suitable for supporting the muzzle end of the firearm on a ledge such as a window sill. In a second embodiment, retractable, folding legs may be mounted to opposite sides of the body of the padded brace.

16 Claims, 4 Drawing Sheets

BRACE FOR STABILIZING A FIREARM

CROSS REFERENCES TO RELATED APPLICATIONS

This application claims the benefit of U.S. Provisional Patent Application Ser. No. 62/047,845 filed on Sep. 9, 2014 which is incorporated herein by reference.

FIELD OF THE INVENTION

This invention relates to an attachment having a bracing surface and a resilient surface for stabilizing the muzzle end of a firearm.

BACKGROUND

Firearm marksmen, particularly military sharp shooters, occasionally have a need for supporting, securing and otherwise stabilizing the muzzle end of a firearm against surfaces, edges and various structures. What is needed is an attachment which presents surfaces which can be used to brace or stabilize a firearm.

SUMMARY

The aforementioned need is addressed by a padded brace. The padded brace includes a body having an attachment portion, a forward brace portion and a padded portion. The attachment portion presents features which are suitable for attaching to a firearm stock. In one embodiment, the attachment portion is arranged to receive and clamp to a standard firearm dovetail rail of the type that is often present under the muzzle end of the stock of a firearm. The forward brace portion preferably presents a forward facing surface which may fashioned from a hard material and finished with a high degree of surface roughness or which may present a resilient gripping surface fashioned from a hard rubber material. In one embodiment, the padded portion extends from the bottom side of the padded brace and extends behind the forward brace portion. The padded portion may be in the form of a bean bag, or a sand bag or other fabric pouch which holds a particulate type material such as plastic beads and the like. The padded portion may also be fashioned from foam rubber or some other suitable material. When in use, the forward brace portion may be used against a solid surface such as in a doorway or a window frame. The padded portion may be used to support the muzzle end of the firearm on a window sill, a horizontal ledge or any other raised, generally horizontal surface.

In an alternate embodiment, telescoping multi-position legs may be mounted to the sides of the body of the padded brace. The telescoping multi-position legs would be able to be folded up in a non-use position when the padded portion of the padded brace is in use but might also be deployed when the padded portion is not in use. The telescoping multi-position legs and the mounting surfaces to which they are attached are described in U.S. Pat. No. 8,402,684 of which one of the applicants is the sole inventor, which is incorporated herein by reference.

DETAILED DESCRIPTION

Figure 1:
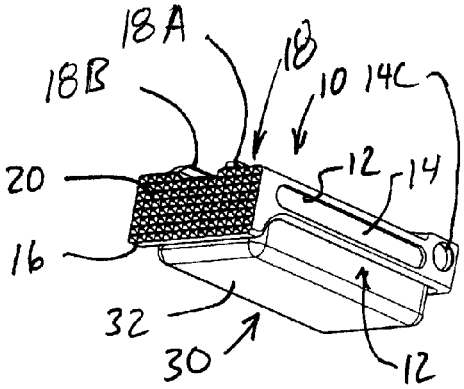
FIG. 1 is a perspective view of one embodiment of the padded brace.
Figure 2:
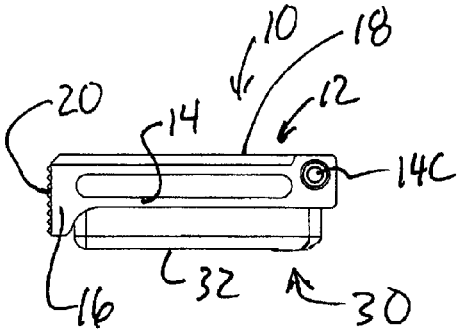
FIG. 2 is a side view of one embodiment of the padded brace.
Figure 3:
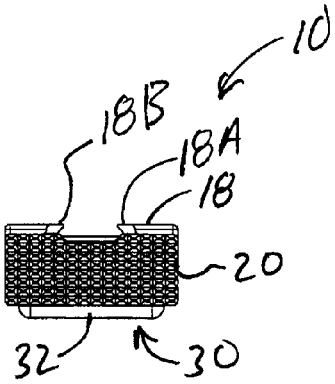
FIG. 3 is a front view of one embodiment of the padded brace.
Figure 4:
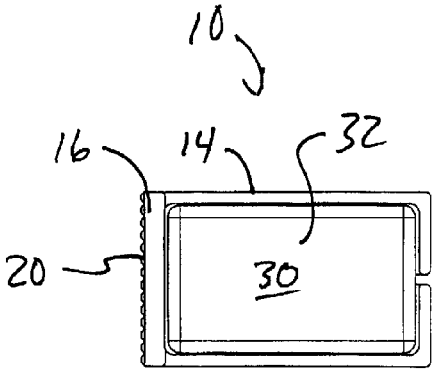
FIG. 4 is a top view of one embodiment of the padded brace.
Figure 5:
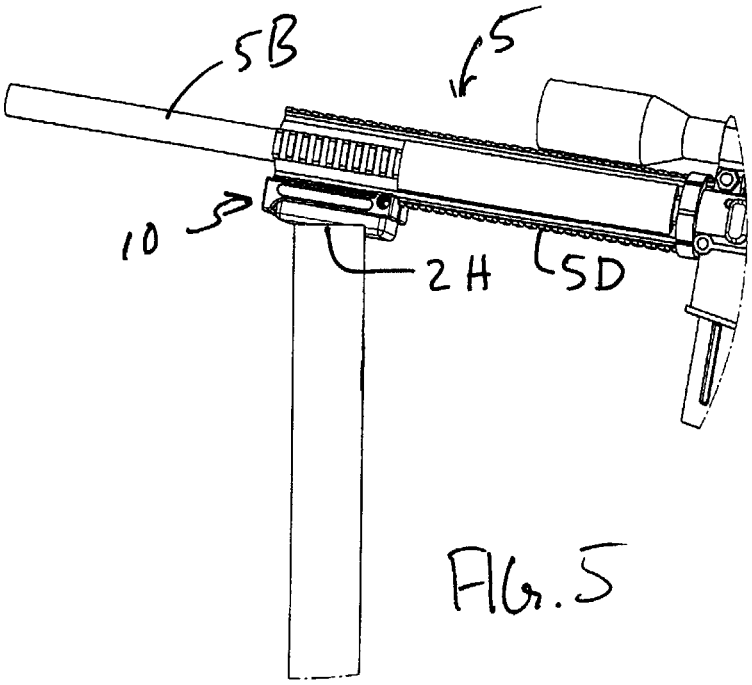
FIG. 5 is side view of one embodiment of the padded brace mounted to a firearm and supporting the firearm on a ledge.
Figure 8:
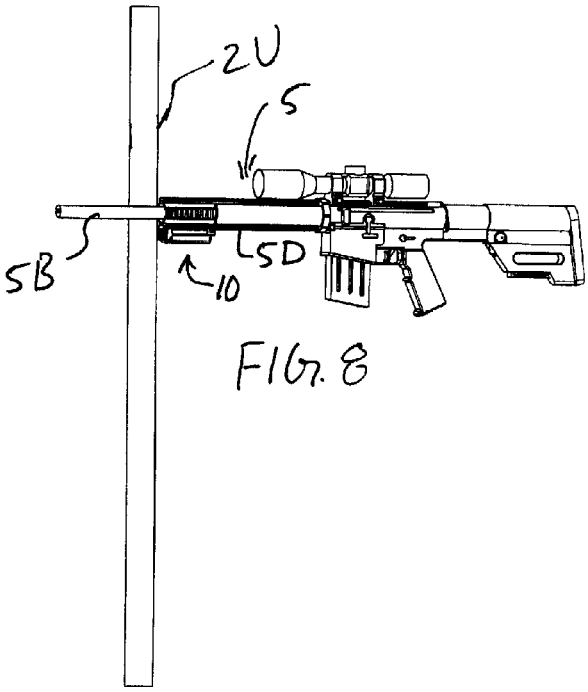
FIG. 8 is side view of one embodiment of the padded brace mounted to a firearm and supporting the firearm against an upright edge.

Referring to the drawings, FIG. 1 illustrates one embodiment of a padded brace 10. Padded brace 10 includes a body 12 which presents a forward brace portion 20, an attachment portion 18 and a padded portion 30. As can be seen in FIGS. 1-4, body 12 (which is preferably fashioned from machined metal such as aluminum) includes a base 14, a forward flange 16 which presents forward brace portion 20. In this example, the upper surface of base 14 presents attachment portion 18, which, in turn, presents a set of longitudinal, parallel rails 18A and 18B. Rails 18A and 18B are arranged for receiving a dovetail rail 5D of a firearm which would be well known to the skilled reader and which is often present on the underside of the muzzle of a firearm such as firearm 5 as shown in FIGS. 5 and 8. A threaded bore 18C is available to receive a correspondingly threaded fastener (not shown) which would be suitable for clamping base 14 on to firearm dovetail base 5D as shown in FIGS. 5 and 8.

As can be seen in FIG. 1, padded portion 30 is fixed to the lower surface of base 12 and presents a padded portion 32 which underlies of base 12. In this example, padded portion 30 is a bag made from a tough flexible material which contains granular material such as beans, plastic pellets, small pebbles or the like. Padded portion 32 is configured so that it will deform under pressure but also present a solid, firm support once it has deformed. As such, padded portion 32 is suitable for supporting the muzzle end of a firearm when it is placed on a horizontal ledge 2H (such as a window sill) as shown in FIG. 5. As noted above, padded portion 32 may also be fashioned from a block of foam rubber material. A foam rubber material having "memory" characteristics which is able to deform and hold its deformed shape might be particularly suitable as a material for padded portion 32.

Figure 6:
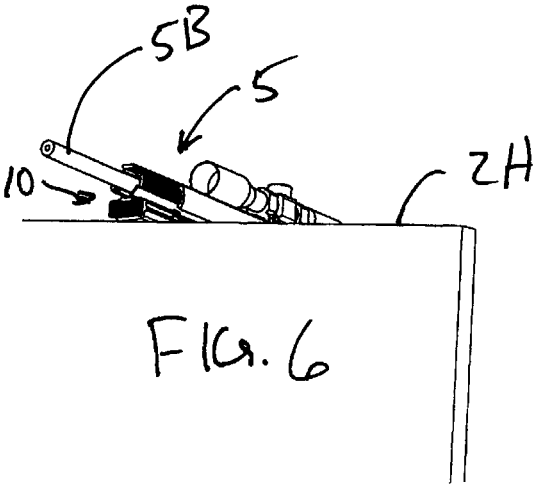
FIG. 6 is first perspective view of one embodiment of the padded brace mounted to a firearm and supporting the firearm on a ledge.
Figure 7:
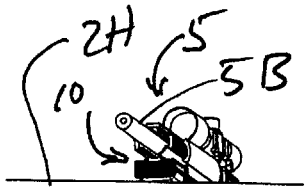
FIG. 7 is second perspective view of one embodiment of the padded brace mounted to a firearm and supporting the firearm on a ledge.
Figure 9:
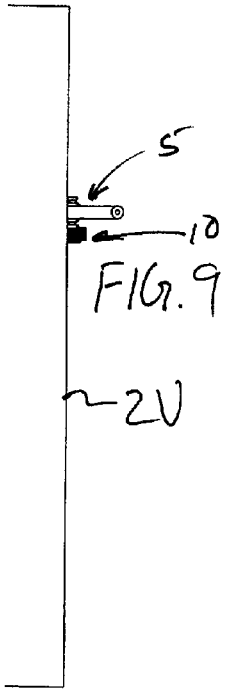
FIG. 9 is front view of one embodiment of the padded brace mounted to a firearm and supporting the firearm against an upright edge.
Figure 10:
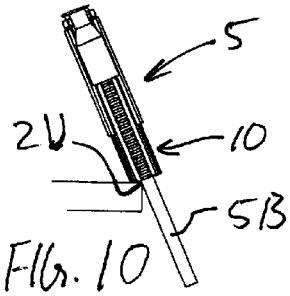
FIG. 10 is top view of one embodiment of the padded brace mounted to a firearm and supporting the firearm against an upright edge.

As can be seen in FIG. 1, in this example, forward brace portion 20 presents a generally upright surface. In this example, the front surface of forward brace portion 20 is deeply knurled in order to present a hard, rough surface which is unlikely to slip or slide and likely to hold fast when pressed upon a smooth surface such as might be presented by typical building materials. The knurling is particularly suitable for engaging wood surfaces such as are presented by doorways and window frames and the like. Superficial damage to such wood surfaces is not a consideration, since the actual use of firearm 5 in such a setting would likely occur in a situation wherein superficial damage to interior or exterior trim would not be of primary concern to the marksman using firearm 5. As noted above, forward brace portion 20 may also present a resilient surface fashioned from a rubber material which is suitable for gripping smooth surfaces. Thus either a hard, knurled surface or gripping rubber surface perhaps even having similar surface features as shown in FIG. 1 would be a suitable gripping surface for forward brace portion 20. The skilled reader will note by referring to FIGS. 9-10, that padded brace 10 is mounted to the firearm rail of a firearm 5 as relatively close to the muzzle so that forward brace portion 20 extends sufficiently to either side of the firearm barrel. Accordingly, forward brace portion 20 preferably has sufficient width so that it can extend on either side of a firearm barrel 5B. As can be seen in FIGS. 8-10, forward brace portion 20 is placed against an upright edge 2U of an upright structure. The marksmen in this position is not merely resting the firearm on a horizontal ledge 2H as in FIGS. 5-7. Here, the marksman is most likely pressing the knurled forward brace portion 20 into the material of upright edge 2U. This is done in order to stabilize and support the forward end of the firearm in preparation for taking aim and firing. Thus, a soft, yielding surface will likely not provide a suitable support when knurled forward brace portion 20 pressed into upright edge 2U. Here, what is needed is a hard, rough, preferably knurled surface for biting into upright edge 2U.

Figure 11A:
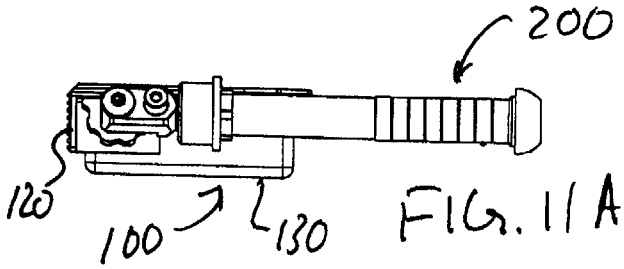
FIG. 11A is side view of one embodiment of the padded brace mounted to a firearm with optional folded legs shown in a folded up position.
Figure 11B:
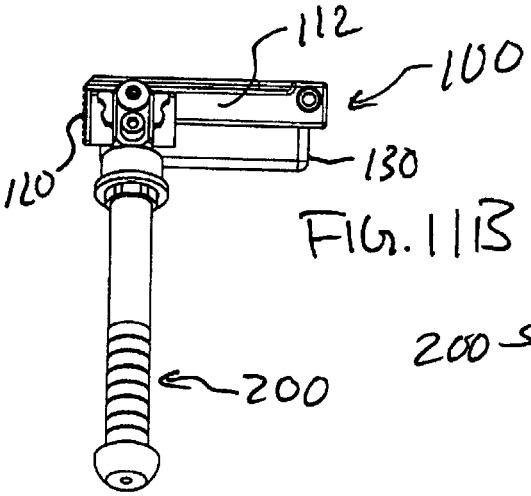
FIG. 11B is side view of one embodiment of the padded brace mounted to a firearm with optional folded legs shown in an upright position as in FIG. 11.
Figure 11:
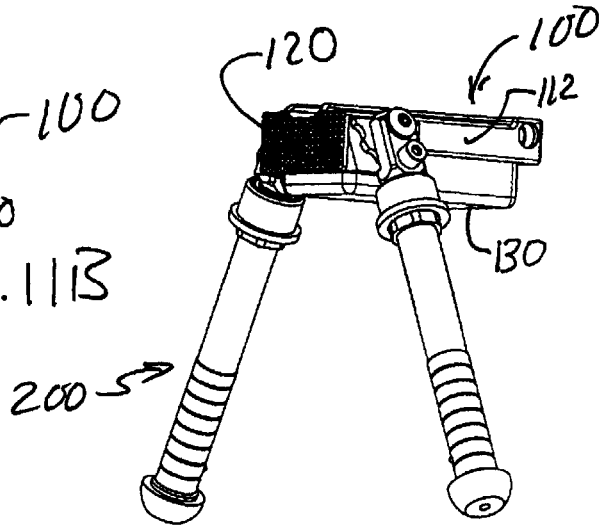
FIG. 11 is perspective view of one embodiment of the padded brace mounted to a firearm and being supported by optional folding legs showing the legs in an upright position.
Figure 11C:
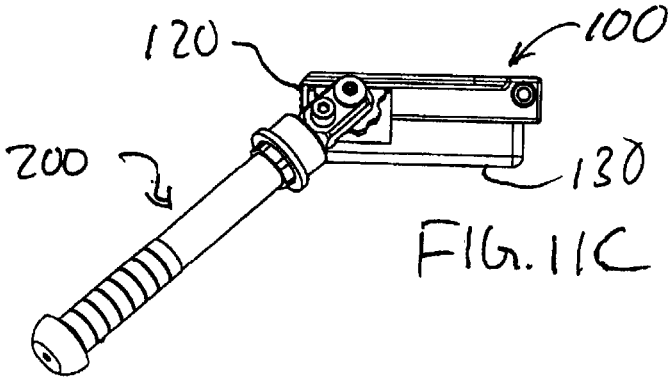
FIG. 11C is side view of one embodiment of the padded brace mounted to a firearm with optional folded legs shown in a forward position.

FIG. 11 and FIGS. 11A-11C illustrate a second embodiment of the padded brace, namely padded brace 100, which also includes a forward brace portion 120 and a padded portion 130. In this second embodiment padded brace 100 includes two side mounted legs 200 which are mounted to sides of body 112 and which may be telescoping for adjusting the length of the legs and adjustable for adjusting the angle of the legs in at least two positions. At minimum, the two positions would include a folded back position as shown in FIG. 11A and an upright extended position as shown in FIG. 11B. However, other positions are possible, such as a forward folded position shown in FIG. 11C and a folded back position which is not shown. The applicants have incorporated by reference U.S. Pat. No. 8,402,684 of which one of the applicants is the sole inventor. U.S. Pat. No. 8,402,684 provides a detailed description of at least one embodiment for legs 200 and the structures to which they mount. If padded portion 120 described above is to be used as shown in FIGS. 5-7, then legs 200 should be folded back as shown in FIG. 11A. If forward brace portion 120 is to be used, then legs 200 should not be placed in the forward folded position shown in FIG. 11C.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A padded brace for supporting a firearm in relation to upright and generally horizontal structural surfaces, the padded brace comprising:

a body which is suitable for mounting to a firearm stock, a forward brace portion extending from a forward end of the body which presents a suitable gripping surface, the suitable gripping surface being knurled, rubber or a combination of both, and configured to frictionally engage an upright structural surface in order to stabilize a firearm to which the padded brace is mounted to facilitate accurate marksmanship, and, a padded portion including padding which is fixed to and directly beneath the body, the padded portion configured to rest on a horizontal surface to similarly stabilize a firearm and facilitate accurate marksmanship.

2. The padded brace of claim 1, wherein:

an upper surface of the body presents longitudinal, parallel rails suitable for receiving a dovetail mount on an underside of a firearm muzzle, at least one of the longitudinal, parallel rails presenting a threaded bore for receiving a threaded fastener for clamping the padded brace to the dovetail mount.

3. The padded brace of claim 1, wherein:

the suitable gripping surface of the forward brace portion is a hard knurled surface.

4. The padded brace of claim 1, wherein:

the suitable gripping surface of the forward brace portion is a rubber surface.

5. The padded brace of claim 1, wherein:

the padded portion is a flexible pouch filled with a granular material.

6. The padded brace of claim 1, wherein:

the padded portion is fashioned from a resilient material.

7. The padded brace of claim 1, wherein:

the body presents opposite leg mount portions on which each of two legs are attached on opposing sides thereof, respectively;

each leg is independently mounted to and movable on each leg mount portion by a leg mount assembly including a pivot connection that is biased in place, each of the opposing sides having a plurality of recesses arranged there about, each leg mount assembly further including a corresponding structure that can mate with and be releasably secured within one of the plurality of recesses so that when the structure is moved relative to a biased condition the leg can be moved around the pivot connection and the corresponding structure can be positioned in one of the plurality of recesses so as to permit each leg to be independently stowable in a rearward manner adjacent the weapon, stowable in a forward manner adjacent the weapon, and adjustably locked in any one of a plurality of positions there between.

8. The padded brace of claim 7, wherein the padded portion is fashioned from a resilient material.

9. A padded brace for supporting a firearm in relation to upright and generally horizontal structural surfaces, the padded brace comprising:

a body which is suitable for mounting to a firearm stock, a forward brace portion extending from a forward end of the body which presents a suitable gripping surface, the suitable gripping surface being knurled, rubber or a combination of both, and configured to frictionally engage an upright structural surface in order to stabilize a firearm to which the padded brace is mounted to facilitate accurate marksmanship, and, a padded portion including padding which is fixed to and directly beneath the body, the padded portion configured to rest on a horizontal surface to similarly stabilize a firearm and facilitate accurate marksmanship, the body also presenting opposite leg mount portions on which each of two legs are attached on opposing sides thereof, respectively.

10. The padded brace of claim 9, wherein:

each leg is independently mounted to and movable on each leg mount portion by a leg mount assembly including a pivot connection that is biased in place, each of the opposing sides having a plurality of recesses arranged there about, each leg mount assembly further including a corresponding structure that can mate with and be releasably secured within one of the plurality of recesses so that when the structure is moved relative to a biased condition the leg can be moved around the pivot connection and the corresponding structure can be positioned in one of the plurality of recesses so as to permit each leg to be independently stowable in a rearward manner adjacent the weapon, stowable in a forward manner adjacent the weapon, and adjustably locked in any one of a plurality of positions there between.

11. The padded brace of claim 9, wherein:

an upper surface of the body presents longitudinal, parallel rails suitable for receiving a dovetail mount on an underside of a firearm stock, at least one of the longitudinal, parallel rails presenting a threaded bore for receiving a threaded fastener for clamping the padded brace to the dovetail mount.

12. The padded brace of claim 9, wherein:

the suitable surface of the forward brace portion is a hard, knurled surface.

13. The padded brace of claim 9, wherein:

the suitable surface of the forward brace portion is a rubber surface.

14. The padded brace of claim 9, wherein:

the padded portion is a flexible pouch filled with a granular material.

15. The padded brace of claim 9, wherein:

the padded portion is fashioned from foam rubber.

16. The padded brace of claim 9, wherein:

the legs are telescoping legs.

* * * * *